United States Patent [19]

Cappellini et al.

[11] 4,170,093

[45] Oct. 9, 1979

[54] METHOD AND APPARATUS FOR ERECTING SUBSTANTIALLY DOME-LIKE BUILDING STRUCTURES

[75] Inventors: Mario Cappellini, Milan; Dario Zucchi, Bologna, both of Italy

[73] Assignee: Binishells New Systems Limited, St. Peter Port, Channel Islands

[21] Appl. No.: 838,427

[22] Filed: Sep. 30, 1977

[30] Foreign Application Priority Data

Oct. 7, 1976 [IT] Italy ..... 28096 A/76

[51] Int. Cl.[2] ..... E04B 1/34

[52] U.S. Cl. ..... 52/741; 52/2; 264/32; 264/34; 264/35

[58] Field of Search ..... 52/2, 748, 741, 309.17; 264/32, 34, 35

[56] References Cited

U.S. PATENT DOCUMENTS

| | | | |
|---|---|---|---|
| 1,329,699 | 2/1920 | Brown | 264/35 |
| 2,335,300 | 11/1943 | Neff | 264/32 |
| 3,462,521 | 8/1969 | Bini | 52/2 |
| 3,597,890 | 8/1971 | Hala | 52/309.17 |
| 3,643,910 | 2/1972 | Heifetz | 264/32 |
| 3,676,976 | 7/1972 | McAllister | 52/2 |
| 4,041,671 | 8/1977 | Nicholson | 52/2 |

FOREIGN PATENT DOCUMENTS

| | | | |
|---|---|---|---|
| 1489329 | 7/1967 | France | 52/2 |
| 561231 | 5/1944 | United Kingdom | 264/32 |

OTHER PUBLICATIONS

Progressive Architecture, Aug. 1959, pp. 138–141.

*Primary Examiner*—James A. Leppink
*Assistant Examiner*—Henry E. Raduazo
*Attorney, Agent, or Firm*—Guido Modiano; Albert Josif

[57] ABSTRACT

A method for erecting substantially dome-like building structures, the method including the steps of arranging elastically deformable reinforcing members on a membrane arranged on the flat and secured to a generally annular foundation, laying a first layer of concrete material on the membrane and reinforcing members and inflating the membrane to assume the desired shape. After the concrete has sufficiently hardened further reinforcing members are arranged on the extrados of the obtained structure and a second layer of concrete material having a thickness greater than the thickness of the first layer of concrete material is layed thereon. The reinforcing members and the two layers of concrete material are connected together. There is also disclosed an apparatus for implementing the above method.

1 Claim, 4 Drawing Figures

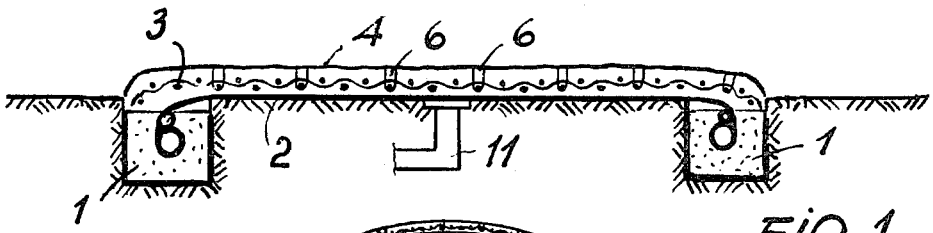
Fig. 1
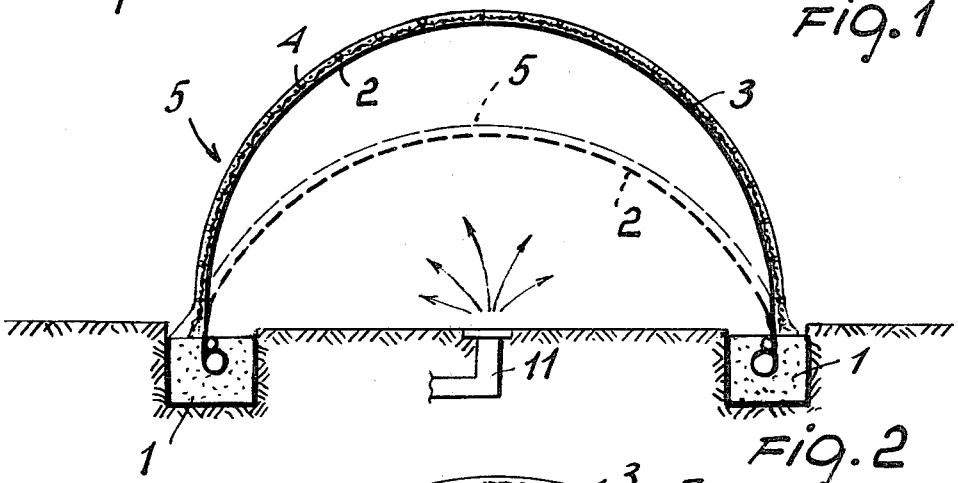
Fig. 2
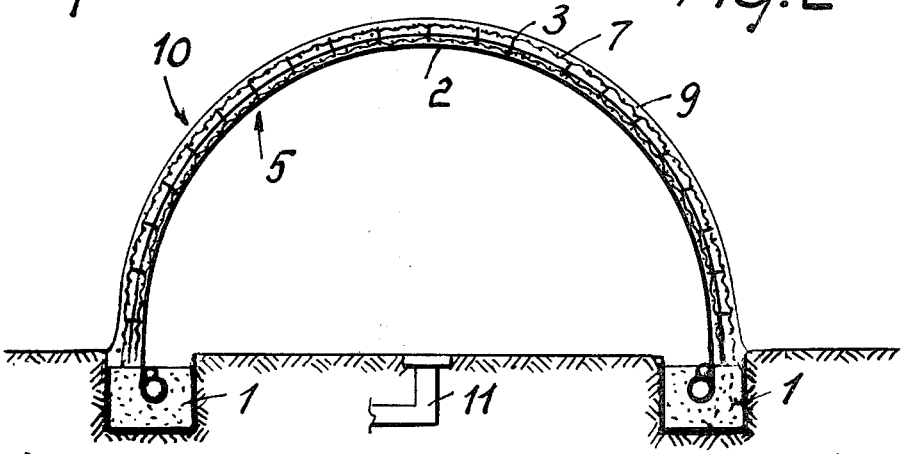
Fig. 3
Fig. 4
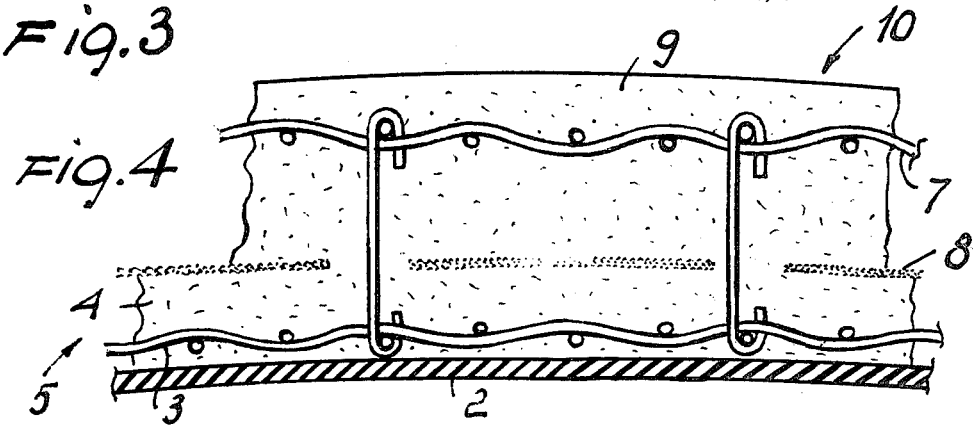

METHOD AND APPARATUS FOR ERECTING SUBSTANTIALLY DOME-LIKE BUILDING STRUCTURES

BACKGROUND OF THE INVENTION

This invention relates to a method and an apparatus for erecting building structures or the like, having a substantially dome-like shape, as well as to a structure thus obtained.

As is known, dome buildings constitute, by virtue of their very shape, specially useful constructions both from an aesthetic standpoint, since they merge easily and pleasantly into the landscape, and from a structural point of view, because they may be formed as a monolithic self-supporting diaphragm which is effectively capable of withstanding stresses and requires, for its construction, a reduced amount of material with respect to more conventional building designs.

However, domed buildings have the disadvantage of being difficult to erect since, if produced with the usual techniques as employed for conventional buildings, they require a complex falsework of correspondingly domed shape for casting the concrete material. These difficulties have been only partly overcome by adopting a support for concrete material casting which comprises an inflatable bag or balloon having the same shape as the dome to be erected. This balloon, owing to the ease wherewith it may be inflated and positioned, represented a simplification in dome building structure forming, for it did away with the necessity for inner dome scaffolding, although it still required outer scaffolding. It is in fact apparent that, even if said inflatable bag can support and hold in shape the concrete material, it cannot provide adequate support, without undergoing considerable deformation, for the weight of the concrete spraying personnel and machines, thereby the outer scaffolding is to be provided.

Such shortcomings have been effectively and uniquely obviated through previous studies and patents which teach the erection of domed building structures by casting the concrete material and positioning the related reinforcement on the flat, directly at ground level, over a membrane which may be then inflated to take a final shape at least in part matching or in agreement with the structure to be erected. In that manner, all of the material was distributed at ground level and the outer scaffolding became unnecessary. Furthermore, with that method, other substantial advantages were secured such as a remarkably shorter erecting time for the entire building structure and a more easily distributed concrete material, since all the operations involved were performed substantially on the ground and required no spraying machines or pumps of specially high power in order to spread the concrete material.

It is thanks to such advantages and to its uniqueness with respect to prior art techniques that the cited method has met with worldwide acceptance. In time, however, ever growing requisites of convenience, size and economy in building structures have led to the requirement for a further evolution of the cited method. In particular, the need is now felt for a more economical erection procedure for such dome-like building structures, as well as of arriving at domes of larger diameters. In fact, when a dome with a diameter of 40 meters (131 feet) up is to be erected, it is necessary to cast, in a short time, onto said elastic membrane, a large amount of concrete, such as to complete the covering of the whole membrane to the desired thickness before the concrete casting has a chance to lose the fluidity required to absorb the deformation imparted thereto by the membrane as it is inflated. It has been found in actual practice, that for domes with diameters equal to or exceeding 40 meters (131 feet), it is particularly difficult to complete the casting operation quickly enough, especially at far out sites or sites lacking casting facilities.

In situations such as mentioned above, the problem is encountered of how to erect large diameter domes while retaining the essential advantage of requiring no prearranged supporting falsework, and while improving the economy and constructional accuracy of the resulting dome.

SUMMARY OF THE INVENTION

It is the object of this invention to provide a method and an apparatus useful to solve in a satisfactory manner said technical problem, such as to make dome-like building structures still more competitive and universally acceptable.

It is a particular object of this invention to reduce the amount of concrete to be spread over the membrane at the ground, before the membrane is inflated.

It is another particular object of the invention to provide a method and an apparatus such as to allow the use of a specially reduced and simplified reinforcement in erecting said dome-like structures.

It is a further object to provide a method and an apparatus allowing the formation of openings and related framing edges and beads simultaneously with the formation of the dome-like structure.

A not unimportant object is to provide a method and an apparatus allowing, in erecting a dome-like building structure, a substantially smooth programmed work procedure, and a utilization of labor facilities presenting no discontinuity peaks, so as to minimize both the labor requirements and the total erection time.

These and other objects, such as will be apparent hereinafter, are achieved by the method according to the invention for erecting substantially dome-like building structures, which comprises setting of a generally annular foundation work, anchoring, to said foundation work, of a membrane adapted to take, upon inflation with a gaseous fluid, a shape at least in part matching the structure to be erected, arranging of first elastically deformable reinforcing members over said membrane, still deflated, and linking of said members to said foundation work, spreading over said deflated membrane and said first reinforcing members of a first layer of concrete material having a thickness dimension such as to result in a first thin dome portion with respect to the final desired thickness of the dome, inflating of said membrane to the desired shape, laying, on the extrados of said first portion as soon as the latter has hardened substantially and while said membrane is still under tension, of second reinforcing members and of a second layer of concrete material, so dimensioned as to result in a second dome portion of prevailing thickness over said first dome portion, and applying a means adapted to make said second portion rigid with said first thin portion.

Advantageously, an apparatus is provided for erecting substantially dome-like building structures, which comprises: a fixed foundation work, a membrane adapted to take, by inflation with a gaseous fluid, a shape at least in part matching the structure to be erected, means adapted to engage the edges of said membrane with said foundation work, first reinforcing members, elastically deformable and self-positioning on said membrane when inflated, means adapted to distribute a first concrete material over said membrane and said first reinforcing members to form a first dome portion, means for blowing a gaseous fluid into and inflate said membrane against the weight of said first reinforcing members and said first concrete material, second reinforcing members, means operative to distribute a second concrete material directly over said already formed first concrete material and said second reinforcing members, to form a second dome portion, and means adapted to rigidly engage to each other said first and second dome portions.

BRIEF DESCRIPTION OF THE DRAWINGS

Further features and advantages will become apparent from the following description of a preferred, though not restrictive, embodiment of the invention, illustrated by way of example and not of limitation in the accompanying drawings, where:

FIGS. 1 and 2 illustrate the various steps of forming a first layer in a dome-like building structure according to the invention;

FIG. 3 shows a further forming step of such a structure; and

FIG. 4 shows a portion of the building structure illustrated in FIG. 3.

DESCRIPTION OF THE PREFERRED EMBODIMENTS

With reference to the drawing figures, the invention provides a method of erecting dome-like building structures, wherein these structures are implemented as two layers which are connected together both by means of their reinforcements, and by means of an adhesive suitable to bind the two concrete layers to each other such as to produce an integral construction. More specifically, according to the instant method, a dome of reduced thickness is erected first, namely a dome having a thickness dimension ranging from 2 to 4 centimeters (0.79 to 1.57 inches), according to the dome diameter, using a technique similar to, but advantageously simplified over, the technique proposed in the cited previous studies. More in detail, the first step of the method starts with the casting, on the ground, of a foundation work 1 having a preferably circular annular shape, thereafter, in the area defined by the foundation work 1, a membrane 2 is arranged which is adapted to take, by elastic deformation, a shape at least in part matching the structure to be erected; then the membrane 2 is sealed to the foundation work 1, first reinforcing members, as schematically indicated at 3, are laid onto the membrane 2 and anchored to the foundation work 1; lastly, the whole is covered with a first layer of concrete material 4 and the membrane 2 is inflated to the desired shape. It is important to observe here that the first reinforcing members 3, while being elastically deformable and self-positioning during the membrane 2 inflation, similarly to those disclosed in the cited previous studies, can be made considerably more simple and economical since they are only designed to fit the dome portion 5 of reduced thickness being produced. Similarly, the first layer of concrete material 4 spread over the membrane at the ground is also a reduced amount.

Advantageously, in laying the first layer of concrete material, holes 6 are left which partially uncover the first reinforcing members 3. These latter include members projecting out of the first layer 4 through the holes 6, as best shown in FIG. 3.

Upon completion of the first part of the structure by inflating the membrane 2, and after the concrete has set, second reinforcing members 7 are distributed over the first dome portion 5, said second members being only schematically and illustratively shown in the drawing figures, and dimensioned and positioned to suit static requirements. These second reinforcing members 7 are then linked or connected in any convenient manner to the first reinforcing members 3 through the holes 6 left in the first layer of concrete material 4. This part of the work is carried out utilizing the support provided by the first dome portion 5, thereby it is necessary that the latter is given a chance to adequately set and harden, at least to the point of being walkable.

While the membrane 2 is still under tension, adhesive material 8 is spread over the extrados of the first layer of concrete material 4, thereafter, by means of spraying machines or pumps, a second layer of concrete material 9 will be cast which has a definitely prevailing thickness with respect to the first layer 4, thus forming a second dome portion 10 which, construction-wise, constitutes the main portion of the structure.

At the same time, according to the inventive method, the reinforcing beads for the openings to be provided in the dome are formed.

The concrete casting, being sufficiently fluid, may then be subjected to vacuum treatment to improve its characteristics.

After this second casting has set, after approximately two days, the membrane 2 is deflated, and the first concrete layer 4 cut out at the openings to be provided, thereby the entire structure is completed and the membrane recovered.

To implement the above-described method, an apparatus is provided which comprises briefly: a membrane 2 which is deformable and substantially matches the surface defined by the fixed generally annular foundation work 1; a means effective to engage the edges of the membrane 2 with the fixed foundation work 1, thus defining, between the membrane and the ground, a substantially gas tight inflation chamber; a means adapted to distribute a first concrete material 4 over the membrane 2 after first reinforcing members 3, of an elastically deformable type and self-positioning onto the membrane, as the latter is inflated, have been placed on the membrane 2, said means being simple on account of the small amount of concrete material 4 which is to be spread at ground level; a means 11 for blowing a gas into said inflation chamber and inflate the membrane 2; a means operative to distribute a second concrete material 9 onto the first concrete material 4, already formed, after positioning thereon second or further reinforcing members, said means being, for example, spraying machines or pumps or the like; and a means for rigidly interconnecting the overlaid layers of the formed dome-like building structure, comprising, for example, connective members directly linking together the reinforcement members 3 and 7, and an adhesive material 8 directly intervening between the two layers of concrete material 4 and 9.

Thanks to the method and apparatus according to this invention, a dome-like building structure is thus obtained which consists substantially of two overlaid layers, each layer incorporating its own reinforcement. The inner layer defines a first dome portion 5, and the outer layer a second dome portion 10. The first dome portion 5 has a thickness dimension which is definitely smaller than the second portion and, contrary to the latter, is provided with a reinforcement of the elastically deformable and self-positioning type. The two reinforcements are linked together, and the two overlaid layers are made integral to each other by an adhesive material at their contact faces.

The invention achieves its object. The unique combination obtained by erecting a first dome portion before the elastic membrane is inflated, and forming a second dome portion, with a prevailing thickness dimension over the former, after the membrane has been inflated and the first portion has substantially set, (rather then either completing the dome assembling at the ground, or onto the inflated membrane, as taught in the prior art) permits the achievement of substantial advantages of both a technical nature and economical.

Of a technical nature, since it becomes possible to form dome-like building structures with diameters equal to or exceeding 40 meters (131 feet) even at particularly ill-served sites, without prejudice for the reinforcement and casting accuracy, and this because the amount of concrete to be spread at the ground rapidly, i.e. before part of the concrete loses its required fluidity, is considerably reduced, owing to the cited small thickness of the first dome portion, and because the second dome portion, being formed after the membrane has been inflated, may be reinforced accurately and formed concurrently with the edges and beads for the openings desired.

Of an economical nature, thanks to the lower material and equipment costs, and to the reduced and rationalized use of labor, since the elastically deformable and self-positioning reinforcement of the first dome portion is somewhat reduced and simplified, and since the work is subdivided and no longer requires extensive concrete castings.

The above-mentioned advantages are achieved, and here resides an essential aspect of the invention, by a method and its related apparatus for erecting dome-like structures, wherein the requirement for scaffolds and supporting falsework is either eliminated or minimized by virtue of the second dome portion being formed in direct superimposition over the first portion. Moreover, it should be noted that the casting of the second dome portion, as requiring an amount of concrete material appreciably lower than that required for the whole dome, poses no special problems as regards the necessity for spray machines or pumps.

It should be further noted that the forming of the domed structure in two discrete layers may be also advantageous in that the inner layer can be made of a finer grade material, to act as internal plastering finish and thus make the dome formation process an even quicker and more economical one.

The invention as herein described is susceptible to many variations and modifications, all of which fall within the scope of the instant inventive concept. Moreover, all of the details may be replaced with technically equivalent elements. In practicing the invention, the materials and dimensions selected may be any ones to suit the application.

We claim:

1. A method for erecting substantially dome-like building structures, comprising setting of a generally annular foundation work, anchoring, to said foundation work, of a membrane adapted to take, upon inflation with a gaseous fluid, a shape at least in part matching the structure to be erected, arranging of first elastically deformable reinforcing members over said membrane, still deflated, linking of said members to said foundation work, spreading over said deflated membrane and said first reinforcing members of a first layer of concrete material having a thickness dimension such as to result in a first thin dome portion with respect to the final desired thickness of the dome, inflating of said membrane to the desired shape, laying, on the extrados of said first portion as soon as the latter has hardened substantially and while said membrane is still under tension, of second reinforcing members and of a second layer of concrete material, so dimensioned as to result in a second dome portion of greater thickness than said first dome portion, and applying a means for making said second portion rigid with said first thin portion, wherein during the step of laying said second layer of concrete material and said second reinforcing members, framing edges are concurrently laid where openings have to be provided in the building structure, said second layer being arranged only outside of said framing edges.

* * * * *